United States Patent [19]

Nagy

[11] 4,072,116

[45] Feb. 7, 1978

[54] OVEREDGE STITCH SEWING MACHINE

[75] Inventor: Joseph Nagy, St. Andre-les-Vergers, France

[73] Assignee: Union Special Corporation, Chicago, Ill.

[21] Appl. No.: 772,702

[22] Filed: Feb. 28, 1977

Related U.S. Application Data

[63] Continuation of Ser. No. 589,302, June 23, 1975, abandoned.

[30] Foreign Application Priority Data

Feb. 24, 1975 France ..... 75 05653

[51] Int. Cl.[2] ..... D05B 65/00; D05B 53/00

[52] U.S. Cl. ..... 112/286; 112/288; 112/299; 112/253

[58] Field of Search ..... 112/286, 288, 299, 253, 112/285, 260, 254, 177, 197

[56] References Cited

U.S. PATENT DOCUMENTS

| | | | |
|---|---|---|---|
| 1,358,567 | 11/1920 | Moffatt et al. | 112/260 |
| 2,488,390 | 11/1949 | Fischbein | 112/260 |
| 2,756,704 | 7/1956 | Lawber | 112/254 |
| 2,854,937 | 10/1958 | Palumbo | 112/177 |
| 2,858,783 | 11/1958 | Lawber | 112/254 X |
| 3,123,033 | 3/1964 | Weigert | 112/197 |

*Primary Examiner*—H. Hampton Hunter

*Attorney, Agent, or Firm*—John A. Schaerli; John W. Harbst

[57] ABSTRACT

The throat slot, arranged in the needle plate for the passage of the needle, has in the right front portion thereof a groove. It is designed to retain the previously formed thread chain and prevent the formation of the overlock stitch until displaced by the passage of a fabric.

5 Claims, 5 Drawing Figures

OVEREDGE STITCH SEWING MACHINE

This is a continuation, of application Ser. No. 589,302 filed June 23, 1975, now abandoned.

BACKGROUND OF THE INVENTION

The present invention relates to industrial sewing machines of the overlock stitch type, designed mainly for effecting an overedge stitch to cover the edge of a fabric. The edge thus being prevented from unraveling. Also, two or more thicknesses of fabric can be sewn together so that the overlock stitch sewing also embodies a joining of these thicknesses of fabric on their edges.

Sewing machines of the overlock stitch type are currently used for making undergarments, night lingerie (linen articles), polo jumpers, and more generally, articles made of jersey, of knitted material, or equally of all material presenting a certain elasticity.

Overlock stitch sewing machines generally comprise at least one needle reciprocating through the front end of a rearward open throat slot in parallel with a chain finger. Two loopers driven in combination with the needle, cooperate to form the overlock stitch sewing.

The overlock stitch sewing can be formed in the absence of the fabric underneath the needle, creating what is called a thread chain. Without particular precautions, this thread chain appears thus at the commencement and at the end of the overlock stitch sewing being sewn in the edge of the fabric.

In order to lessen, at least partly, the inconvenience of using this machine with the resulting increase of time and of the price of fabrication, it has been proposed to insert an initial thread chain into the overlock stitch sewing itself, so as to block or backtack. By so backtacking the end of the stitch, the tendency to open is substantially lessened.

In order to realize automatically this inserting of the thread chain, an overlock stitch sewing machine was equipped with a Union Special Corporation Machine 39600 means arranged in front of the needle and able to retain the free end of this thread chain until it could be sewn into a fabric means.

It has appeared, nevertheless, that this equipment is not always satisfactory. In fact, the presence of a cutting device with blades in front of the needle, in alignment with the chain finger, does not permit the immediate positioning of the fabric in front of the needle, when the cutting blade is in its low position. The overlock stitch sewing is thus started on the edge of the thread chain itself, even before the material arrives under the needle. Such a premature function of the overlock stitch creates the appearance of a loop or an accumulation of ugly looking stitches at the edge of the sewn fabric.

In order to prevent such a defect, the machine is stopped with the cutter blade in a raised position. It is then possible to introduce the pieces of material, after lifting the presser foot, just up to the needle. The overlock stitch sewing is then carried out immediately across the edge of the material and the thread chain is then progressively sewn in.

This solution, which is applied at the present in a majority of machines presents the drawback of being very expensive. It also necessitates the use of a special driving motor comprising a stopping device associated with the motor shaft, so that the motor always stops in the same position. Such a motor is expensive and greatly increases the price of the overlock stitch sewing machine.

It is therefore an object of this invention to provide an apparatus which permits a satisfactory insertion of thread chain without the need of such a driving motor.

Another object of this invention is to provide a throat plate housing means which allows the thread chain to be positioned whereby further formation thereof is prevented.

Still another object of this invention is the provision of a depression or groove in the edge of the throat plate adjacent the throat slot for positioning and retaining a thread chain to avoid accidental cutting thereof by the knives.

SUMMARY OF THE INVENTION

More precisely, the invention herein described is characterized by the nature of the throat slot arranged in the plate for the passage of the needle. In front of the point of passage of the needle is a small hollow space arranged in such a manner that it retains the thread of the previously formed thread chain. This prevents the formation of an overlock stitch until the fabric to be sewn passes under the needle and dislodges the thread chain.

In a preferred arrangement, a retaining means is placed under and on the side of the needle plate to secure the thread chain in the predetermined position. In a preferred embodiment the retaining means includes two convex flanges pressed against one another by a spring means for retaining part of the thread chain therebetween.

A thread interrupting means is provided adjacent the retaining flanges so as to permit the operator when inserting a thread chain between the retaining means to cut simultaneously the excessive length thereof.

The invention is thus directed to a needle plate for sewing machines of the overlock stitch type as defined here above and the throat slot means which extends in parallel with the chain finger, having in the neighborhood of the needle hole a small cavity arranged in front thereof and slightly displaced in realtion to it.

DESCRIPTION OF THE DRAWINGS

The invention will be better understood by reading the description which follows and referring to the attached drawings, given solely as an example and in which.

DESCRIPTION OF THE INVENTION

Figure 1:
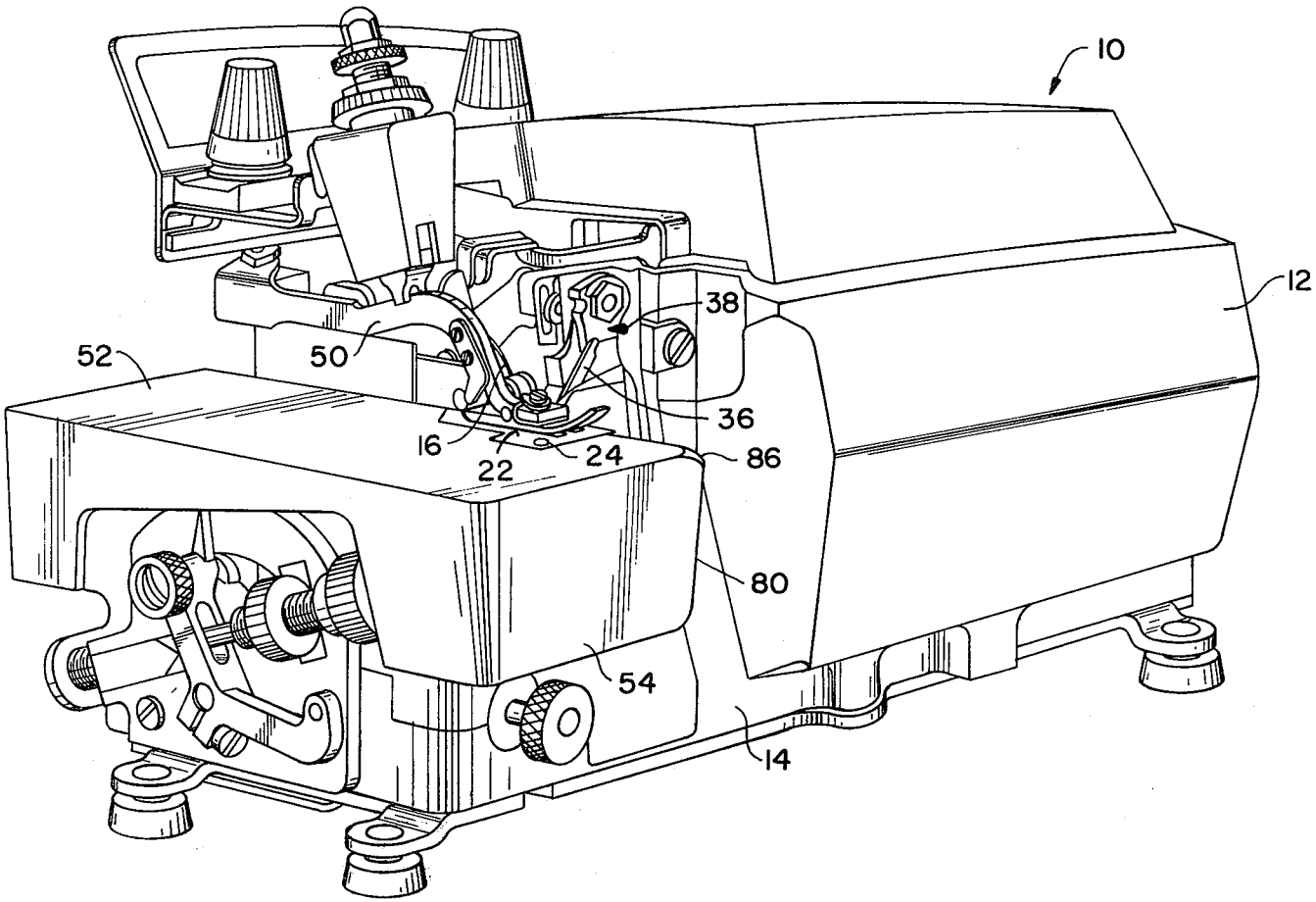
FIG. 1 is an illustration from an operator's perspective of a sewing machine according to the invention.

Referring now to FIG. 1 under 10 is schematically represented an industrial sewing machine of the "overlock" type, designed to sew the edge of a piece of fabric by a particular stitch class called "overlock stitch sewing" or an overedge thread to prevent the unraveling of the edge. This sewing, in which a great variety of stitch classes exists, is used for overedging operations on a simple thickness as well as for operations of assembling several thicknesses of fabrics. The overlock stitch type allows a great degree of elongation and is particularly suitable for fitting relatively elastic pieces of fabrics, such as knits, jerseys, etc.

The overlock stitches used most currently are relatively complex stitches requiring two or preferably three threads, i.e. a needle thread, a lower looper thread, and an upper looper thread.

The machine 10 can be one such as manufactured by Union Special Corporation and identified as a 39500 overedger. Thus it is not necessary to describe within the framework of the present application all the multiple mechanisms which are incorporated in it. These mechanisms, though complex in their structure, considering the high performance required from industrial machines, will be considered as known and it suffices for the reader, in order to complete the following description, to refer to the available technical literature.

Briefly, the machine 10 includes essentially a means 12, mounted on a chassis 14 for driving a plurality of mobile elements, able by their cooperation to form the overlock stitch. Several of these elements will be discussed for the sake of clarity.

Figure 2:
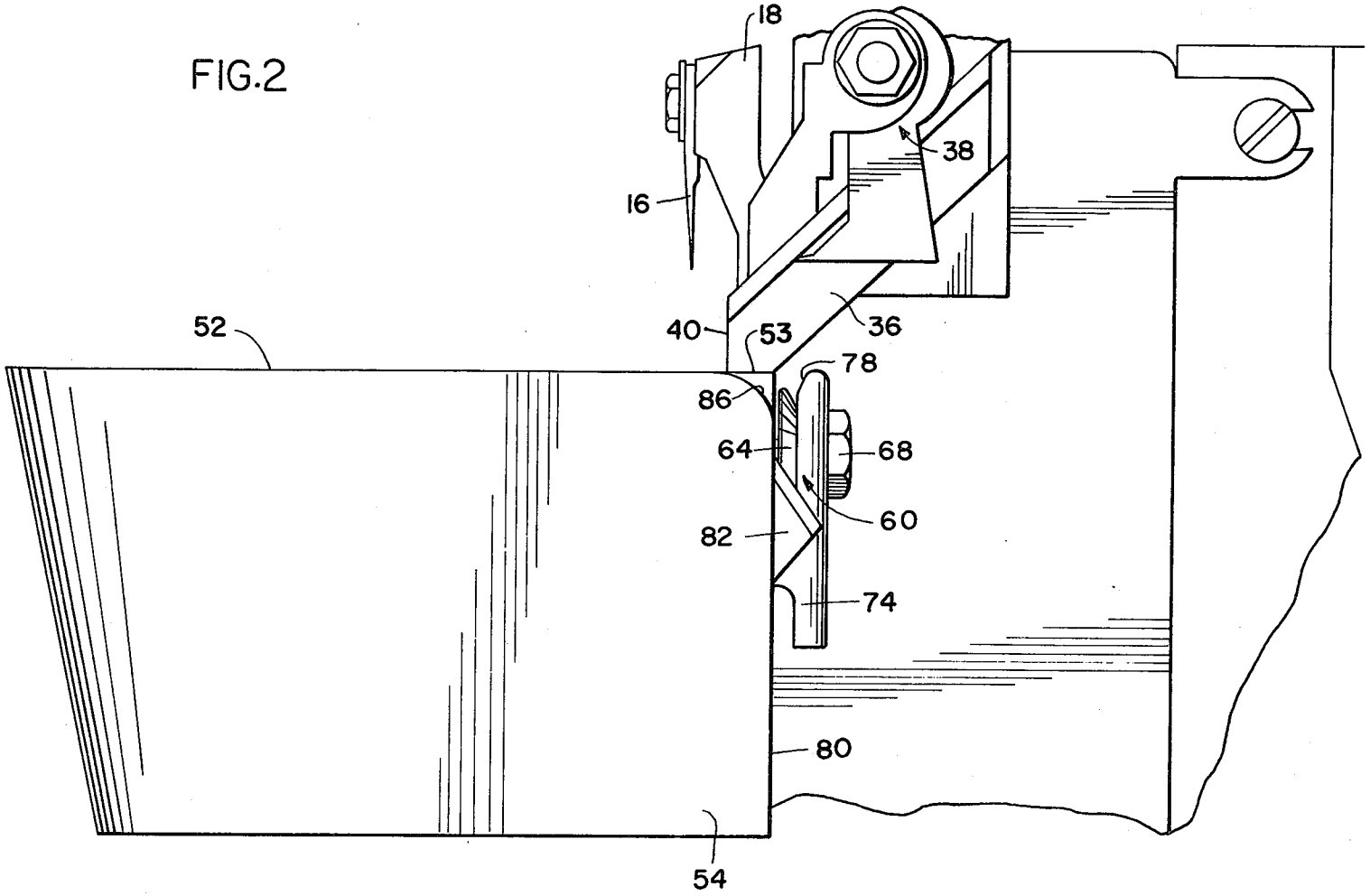
FIG. 2 is a partial, frontal view in the working plane of the machine of FIG. 1.

A curved needle 16 is mounted advantageously in an adjustable manner on a pivoting needle bar 18 (see FIG. 2). Thus it can be reciprocatingly driven through a throat slot means 20 (see FIGS. 3 and 4) of a needle plate means 22, attached by means of a screw 24 to the casing 14.

A pair of looping hook means (not shown) driven equally reciprocatingly needle means 16, so as to form the overlock stitch around a chain finger means 26, generally of a triangular shape. The chaining finger 26 being in the needle plate 22 in parallel with the throat slot 20. The loopers are respectively displaced above (top looper) and below (lower looper) the needle plate 22, in order to achieve the various, necessary loops for the overlock stitch. In case that the machine uses two threads, the loopers are integral. In the illustrated case, where the machine uses three threads, each looper moves according to a given law in function of the variety of the selected overlock stitches.

A set of feed dog means 28 and 30 (see FIGS. 3 and 4), moving in the slot means 32 and 34 opened in the needle plate 22 in parallel with the throat slot means 20 and in the normal sense of advance of the fabric, as indicated by the arrow *f*.

A fabric cutting knife means 36 is placed adjustably on the blade support means 38. The driving of the support 38 is such that the cutting end means 40 of the cutting blade (36) cooperates in the manner of the arms of a pair of scissors with a stationary cutter blade 42. This one being fixed to the framework 10 and attached beneath the needle plate 22. Thus blade 44 is level with the surface of plate 22 in parallel with the direction *f* in an opening 46.

The machine also includes other means namely a presser foot means 50, the displacement of which in respect to the needle plate 22 (lifted or lowered) is controlled by an electric, pneumatic, or hydraulic power device at the disposal of the operator.

The working plane defined by the needle plate 22 is advantageously extended leftward from the needle 16 — considering the sense *f* of movement of the fabric — by the base plane 52 of a removable casing 54.

According to the invention, the throat slot 20 presents at its front section means 21 crossed at 56 by the needle 16 a slight hollowing, channel or groove means 58. The groove means 58 extends in front of the point 56 of the needle 16 in the throat 20 from the bottom surface 23 to the top surface 25. The hollowing is furthermore sensibly displaced rightward from the point 56, considering the direction of feed *f* and the needle center line 27. The junction of the groove 58 to the edges of the throat slot 20 being naturally very "feathered" mainly in the sense of the arrow *f*. Actual cutouts in the throat plate, from top to bottom thereof, or simply extentions of the throat slot are known. However, such means do not achieve the result of receiving and then holding or retaining a thread chain which is being worked with.

Figure 4:
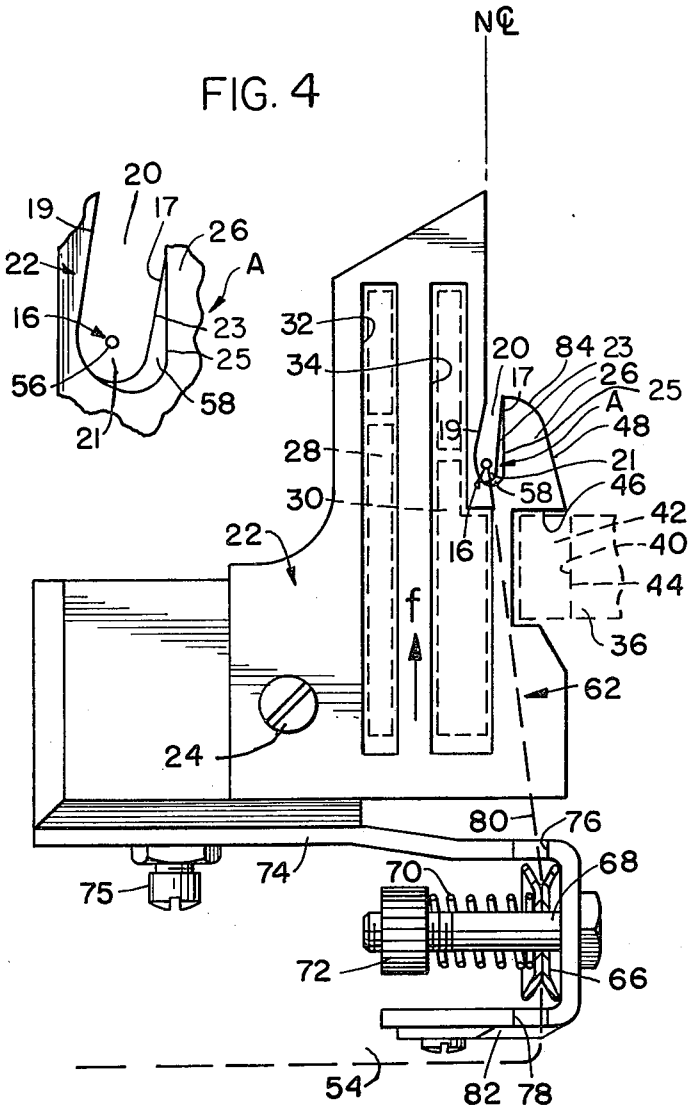
FIGS. 3 and 4 illustrate two embodiments of the needle plate of the machine of FIG. 1.
Figure 3:
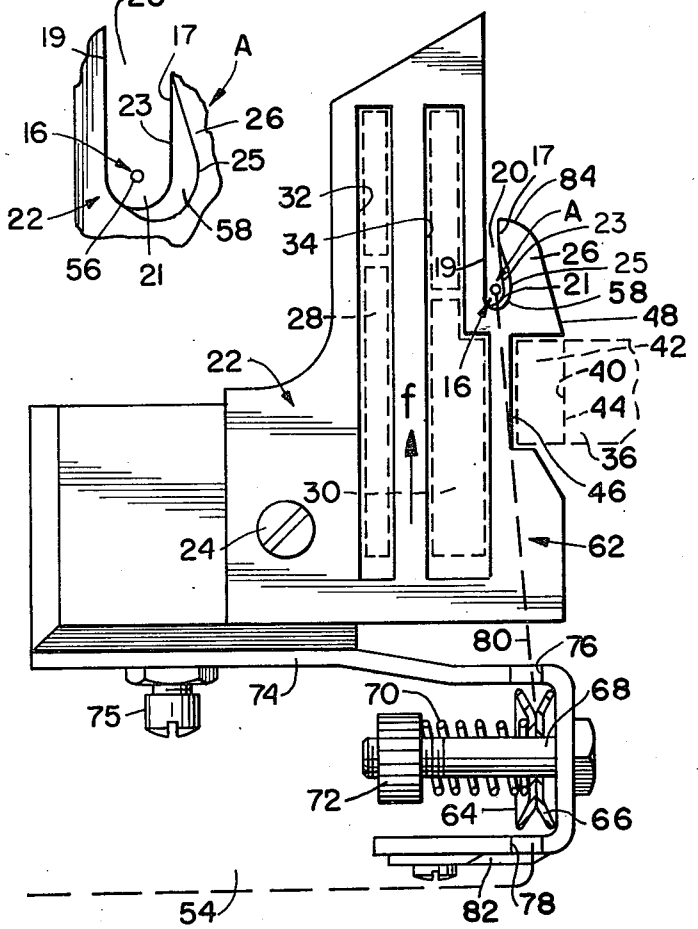
Figure 5:
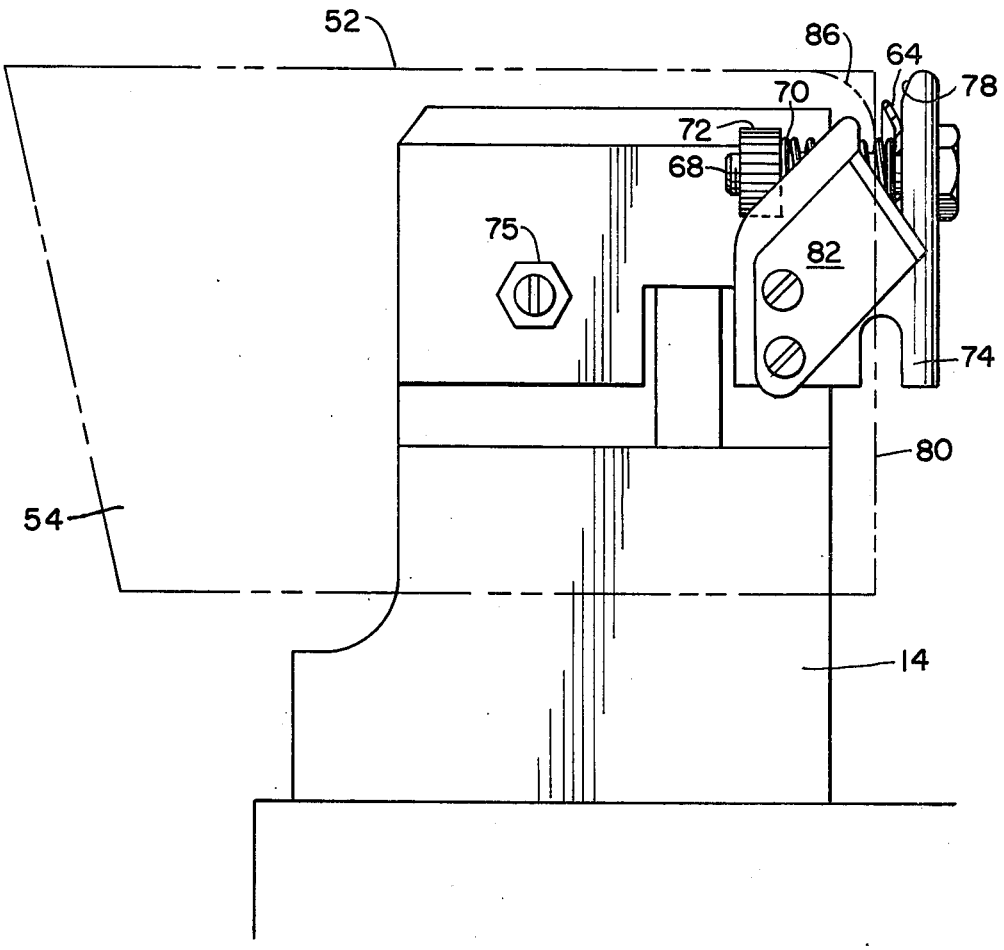
FIG. 5 is a partial, front view illustrating the retaining and cutting means used in the device of FIG. 1.

If the precise shape of the groove 58 in one embodiment is shown in FIGS. 3 and 4 (details A), it follows that the invention is not limited to this particular shape. In order to give a functional definition thereof it suffices to say that it has to be arranged so that at the formation of the thread chain it is urged or carried therein while tension is maintained at the free end thereof. The tension acting on the free end of this thread in a sensibly opposite direction of the arrow *f* (after having been released from the chain finger 26) thus the overlock stitch is not formed, because in this position the needle 16 enters next to the already formed loops of the thread chain and cannot form with the loopers to create new stitches. Thus no new stitches are formed as long as this situation is maintained. It is, nevertheless, clear that the passage of a fabric under the needle 16 via the action of the feed dogs 28 and 30 and of the presser foot 50, will displace the thread chain to its normal position with respect to the needle 16 and from that point overlock stitch will again normally be formed.

For maintaining, at the commencement of a new sewing operation, the thread chain in the groove means 58 the invention foresees to arrange a retaining means 60 in front of the needle 16 and of the cutter means 36 - 42.

The retaining means 60 has the function to retain an end portion of the thread chain until the tension acting upon it, such as is generated by the leading edge of the fabric, exceeds a predetermined value. It must be particularly pointed out that the retaining force of the means 60 must be superior to the driving force exercised by the fabric during its advance under the presser foot 50 up to the needle 16, thus, to retain up to this moment the formation of the thread chain by holding it in the groove means 58.

The retaining means 60 is preferably placed in front of the needle plate 22 at a slightly lower level. Just as the groove 58, it is also displaced to the right of the needle 16 — considering it in the direction of feed *f* — so that the chain occupies a position such as indicated at 62 on FIGS. 3 and 4.

In the embodiment shown, the device 60 consists of two convex flange means 64 and 66, mounted on the same stationary shaft 68, passing through their center, and a spring 70 threaded on this shaft and maintained under a certain stress by a knurled nut 72, threaded on the end of the shaft. The shaft 68 is mounted on the frame 14 by means of a yoke 74 attached thereto in a suitable manner such as a screw 75. The yoke 74 presents two aligned notches 76 and 78 for the passage of the thread chain between the two flanges 64 and 66. The useful dimension of the surfaces in respect to the latter is selected preferably of the same order of size and length of the blade of the cutters 36 and 42. This distance corresponds to the length the fabric has to advance beneath the presser foot 50 before reaching the needle 16, where the maximum tension forces are exercised by the fabric upon the thread chain. With such a dimension and also at such a surface of constriction of the thread chain, the above mentioned condition concerning the force of retention of the device 60 is easily fulfilled.

It will be noted that the corner 53 of the casing 54 is cut or rounded at 80 toward a vertical plane of the flange 64 in order to facilitate the introduction of the thread chain between the two flanges 64 and 66.

A cutting device, such as a blade 82, is advantageously positioned in front of the retaining device 60 so as to permit the operator to cut the excess length of the thread chain.

The operation of the above described includes the following:

The machine is initially stopped and the thread chain formed which is attached to the needle 16 and to the loopers, the base of this chain being carried by the chain finger 26.

The operator, after having raised the presser foot, pulls the end of the thread chain in the direction of feed and then in a semi-circle on the plate 52 so as to disengage at the base of the thread chain from the chain finger 26 (the outer edge 48 of this latter is advantageously rounded at 84 for facilitating the release of the overlock stitches which are formed there.

At the end of the displacement, the operator pulls downward the thread chain which, sliding around the curvature at 80 on the corner of the housing 54, penetrates between the flanges 64 and 66 and is then cut to the desired length on the blade 82. The retaining device 60 retains the thread of the chain under the appropriate stress in the indicated direction until a new fabric piece is sewn.

When a new piece of fabric is to be sewn, the operator introduces its edge under the presser foot, always raised to the level of the cutter 36 and 42. The machine having been stopped in whatever position, the mobile cutter 36 can be in high, medium or low position so that the edge of the piece of fabric might at least approach the needle 16. In the absence of the device according to the invention, the fact of being unable to move the edge of the fabric directly up to the needle would cause, as it is known, the formation of a loop or defect at the commencement of the sewing operation.

The operator lowers the presser foot 50 and starts the machine. The needle 16 and the looping hooks, though driven by the motor, are not capable of forming the overlock stitch. Due, as previously discussed, to the fact that the chain is retained by means 60 in the groove 58, i.e., outside of the path of the needle 16.

During this time, the fabric, is moved toward the needle 16 by the movement of the feed dogs 28 and 30 and the outer edge of the fabric is progressively cut off by the set of cutters 36 and 42.

When the edge in front of the piece of fabric arrives under the needle 16 and caught thereby the thread chain is pulled from the retaining means into the path of the needle, so that the overlock stitch can be formed again and the thread chain is sewn into the fabric. As a result the fabric is not retained and moves normally under the presser foot 50, the chain escapes progressively from the flanges 64 and 66 of the retaining device 60 so as to be inserted progressively into the overlock stitch sewing during its formation.

The invention thus described is capable by the combination of the groove means 58 and the retaining means 60, to effect an overlock stitch sewing on a piece of fabric by inserting the thread chain, without letting a loop or an accumulation of stitches to form at the commencement of the sewing operation. The fact of preventing the formation of a stitch until the arrival of the fabric under the needle permits the positioning of the fabric under the presser foot 50 regardless of the position of the cutter 36.

It is understood that the invention is not limited to the specific embodiment above described realization and that it finds its use in all the over-lock stitch sewing machine using one or several needles (of a straight or curved shape), two or three threads in order to form a determined variety of overlock stitches.

Thus it is apparent that there has been provided, in accordance with the invention, a Thread Chain Positioning Means that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A sewing machine capable of producing thread chain having a thread chain positioning means for guiding the thread chain in a predetermined manner comprising:

a throat plate means;

a throat slot means located along the needle center line of said sewing machine;

a groove means beginning at said throat slot means and extending to the right of the needle center line and being capable of carrying a thread chain; and a thread retainer means positioned in front of said throad slot means generally in line with said groove means.

2. The sewing machine of claim 1 wherein:

said groove means is located in said throat plate means and includes a generally upwardly sloping depression from left to right;

thread retaining means located in front of said groove means securing thread such that the major axis of said thread is parallel with the major axis of said groove means; and thread interrupting means located generally adjacent of said thread retaining means.

3. The sewing machine of claim 2 wherein:

thread passing from said throat slot means through said groove means to said retaining means defines a generally straight line; and a knife means located adjacent said thread defined straight line.

4. The sewing machine of claim 3 wherein:

said throat plate means includes a throat slot side, and top and bottom side means; and said groove means intersects said throat slot side and said top side means.

5. A sewing machine capable of producing a thread chain having a thread chain positioning means for guiding the thread chain in a predetermined manner comprising:

a throat plate means;

a throat slot means in said throat plate means, said throat slot means being located along the needle center line of said sewing machine and having a front section means and right and left side section means;

the front section means of said throat slot means having a forwardly sloping groove means capable of carrying a thread chain; and a thread retainer means positioned in front of said throat slot means generally in line with said groove means.

* * * * *